US008850621B2

(12) United States Patent
Carter-Cohen

(10) Patent No.: US 8,850,621 B2
(45) Date of Patent: Oct. 7, 2014

(54) LEG-WORN STORAGE DEVICE

(71) Applicant: Andrea Paige Carter-Cohen, New York, NY (US)

(72) Inventor: Andrea Paige Carter-Cohen, New York, NY (US)

(73) Assignee: Andy Paige Style, Inc., New York, NY (US)

( * ) Notice: Subject to any disclaimer, the term of this patent is extended or adjusted under 35 U.S.C. 154(b) by 3 days.

(21) Appl. No.: 13/845,711

(22) Filed: Mar. 18, 2013

(65) Prior Publication Data

US 2013/0239299 A1 Sep. 19, 2013

Related U.S. Application Data

(60) Provisional application No. 61/611,788, filed on Mar. 16, 2012.

(51) Int. Cl.

| | |
|---|---|
| ***A41F 19/00*** | (2006.01) |
| ***A45F 5/02*** | (2006.01) |
| *A45F 5/00* | (2006.01) |

(52) U.S. Cl.

CPC ..... *A45F 5/022* (2013.01); *A45F 2005/008* (2013.01); *A45F 5/00* (2013.01); *A45F 2200/055* (2013.01)

USPC ..... 2/300

(58) Field of Classification Search

USPC ..... 2/16, 170, 162, 267, 239, 247, 248, 2/250, 242, 911, 22, 24, 300, 311, 312, 2/315, 317

See application file for complete search history.

(56) References Cited

U.S. PATENT DOCUMENTS

| | | | | |
|---|---|---|---|---|
| 1,025,643 | A | | 5/1912 | Presmont |
| 2,223,665 | A | | 12/1940 | Thun |
| 2,277,766 | A | | 3/1942 | Klumpp |
| 2,329,899 | A | | 9/1943 | Herbener |
| 3,669,096 | A | * | 6/1972 | Hurwitz ..... 600/499 |
| 3,670,933 | A | * | 6/1972 | Jones ..... 224/222 |
| 4,462,116 | A | * | 7/1984 | Sanzone et al. ..... 2/170 |
| 4,852,188 | A | | 8/1989 | Marsh et al. |
| 5,115,519 | A | * | 5/1992 | Dalrymple ..... 2/311 |
| 5,329,638 | A | * | 7/1994 | Hansen et al. ..... 2/16 |
| D360,073 | S | | 7/1995 | Schrader et al. |
| 5,664,263 | A | * | 9/1997 | Reynolds ..... 2/239 |
| 5,671,481 | A | | 9/1997 | Giard |

(Continued)

FOREIGN PATENT DOCUMENTS

WO WO2004002260 A1 8/2004

*Primary Examiner* — Tejash Patel

(74) *Attorney, Agent, or Firm* — JP Webb; Jason P. Webb; Danny Y. H. Cheng

(57) ABSTRACT

There is a leg-worn storage device configured to store objects about a leg of a user. The device includes a cylindrical band of two-way elastic fabric. The cylindrical band includes an interior layer of two-way elastic fabric having a friction enhancing texture layer protruding therefrom and penetrating thereinside. The cylindrical band includes an exterior layer of two-way elastic fabric coupled to the interior layer. The cylindrical band includes a pocket formed between the interior layer and the exterior layer; wherein the pocket is selectably accessible from an exterior of the cylindrical band this permitting the storage of objects. The cylindrical band includes a first end region selectably coupled to a second end region. The cylindrical band includes a mating coupling device disposed at each of the first end region and the second end region and configured to selectably couple the first end region to the second end region.

18 Claims, 6 Drawing Sheets

(56) References Cited

U.S. PATENT DOCUMENTS

| | | | | |
|---|---|---|---|---|
| 5,836,019 | A * | 11/1998 | McCafferty | 2/239 |
| 6,425,137 | B1 * | 7/2002 | Fakhrai | 2/170 |
| D473,048 | S | 4/2003 | DiLorenzo | |
| D506,059 | S | 6/2005 | Goldberg | |
| 7,393,336 | B2 | 7/2008 | Sloot | |
| 7,865,970 | B2 * | 1/2011 | Giacheri | 2/22 |
| 2005/0193476 | A1 | 9/2005 | Chinn | |
| 2009/0235938 | A1 | 9/2009 | Roach | |
| 2010/0100024 | A1 | 4/2010 | Reid, Jr. | |
| 2010/0139049 | A1 | 6/2010 | Glickfield | |
| 2010/0258601 | A1 | 10/2010 | Thrope | |
| 2010/0304899 | A1 | 12/2010 | Roman | |
| 2011/0131707 | A1 | 6/2011 | Sauer | |
| 2012/0210494 | A1 | 8/2012 | Crockett | |
| 2012/0324961 | A1 | 12/2012 | Clemendot | |

* cited by examiner

LEG-WORN STORAGE DEVICE

CROSS-REFERENCE TO RELATED APPLICATIONS

This invention claims priority, under 35 U.S.C. §120, to the U.S. Provisional Patent Application No. 61/611,788 to Andy Paige filed on Mar. 16, 2012, which is incorporated by reference herein.

BACKGROUND OF THE INVENTION

1. Field of the Invention

The present invention relates to storage devices, specifically to a leg-worn storage device.

2. Description of the Related Art

Garters are articles of clothing, such as narrow bands of fabric fastened about the leg, used to keep up stockings, and sometimes socks up. Normally just a few inches in width, they are usually made of leather or heavy cloth, and adorned with small bells and/or ribbons. In the eighteenth to twentieth centuries, they were tied just below the knee, where the leg was slenderest, to keep the stocking from slipping. The advent of elastic has made them less necessary from this functional standpoint, although they are still often worn for fashion. Garters are worn by men and women.

Both men and women are faced with the need to carry various articles, for example, keys, money, identification, credits cards, personal care items, medical devices, work related items, mobile phones, and the like while going about their daily lives. While there are many existing products and solutions which meet this need such as pocketbooks, bags, and other carriers, they can be cumbersome and inconvenient to hold and carry and can become separated from their owners by being misplaced or stolen.

The inventions heretofore known to suffer from a number of disadvantages which include being limited in use, being difficult to use, being bulky, being unattractive, being cumbersome, being expensive, being limited in application, being limited, causing binding, being inconvenient, being obvious when used, not being sexy, requiring the use of hands/arms, not being feminine, being bulky, slipping, not being secure, limiting the users freedom, requiring bags, not being fun to wear, limiting options of the user, failing to increase confidence of the user, decreasing confidence of the user, not facilitating microphone use, being unappealing, being unattractive, not being durable, not replacing other garment items such as but not limited to garters, not being useful, being uncomfortable, failing to adhere properly to the user especially during physical activity, limiting the number of activities the user can participate in, requiring that the user keep track of an item, failing to provide immediate access to medical items, and the like and combinations thereof.

What is needed is a storage device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available storage devices. Accordingly, the present invention has been developed to provide an efficient and effective leg-worn storage device.

According to one embodiment of the invention, there is a leg-worn storage device configured to store objects about a leg of a user. The device may include a cylindrical band of two-way elastic fabric. The cylindrical band may include an interior layer of two-way elastic fabric that may have a friction enhancing texture layer protruding therefrom and penetrating thereinside. The friction enhancing texture layer may be silicone.

The cylindrical band may include an exterior layer of two-way elastic fabric that may be coupled to the interior layer. The cylindrical band may include a pocket that may be formed between the interior layer and the exterior layer; wherein the pocket may be selectably accessible from an exterior of the cylindrical band this permitting the storage of objects. The pocket may be formed by stitching of the interior layer to the exterior layer. The exterior layer may be taller than the interior layer, thereby substantially concealing the interior layer when in use. The exterior layer may consist essentially of two-way elastic lace.

The cylindrical band may include a middle layer of two-way elastic fabric that may be coupled between the interior layer and the exterior layer. The cylindrical band may include a first end region that may be selectably coupled to a second end region. The cylindrical band may include a mating coupling device that may be disposed at each of the first end region and the second end region and may be configured to selectably couple the first end region to the second end region. The cylindrical band may include a secondary coupling device that may be disposed near the second end region and may be configured to selectably couple the second end region thereto.

The cylindrical band may include a pocket flap that may be disposed about an aperture of the pocket and may be configured to secure objects within the pocket. The cylindrical band may include an elongated coupling device that may be extending from the pocket and may be configured to selectably couple to a personal object.

According to one embodiment of the invention, there is a method of manufacturing a leg-worn storage device that may include the step of providing an interior layer of two-way elastic fabric. The method may include the step of impregnating the interior layer of two-way elastic fabric with a friction enhancing texture layer such that the friction enhancing texture layer is imbedded within the interior layer and extends outwardly therefrom. The method may also include the step of providing a middle layer of two-way elastic fabric and providing an exterior layer of two-way elastic fabric. The method of manufacturing a leg-worn storage device may include the step of coupling the interior layer of two-way elastic fabric to the middle layer of two-way elastic fabric and to the exterior layer two-way fabric to form a cylindrical band of two-way elastic fabric having a plurality of interior pockets configured to store object therein and a friction-enhanced interior surface configured to adhere to a leg of a user when worn about a leg of a user.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
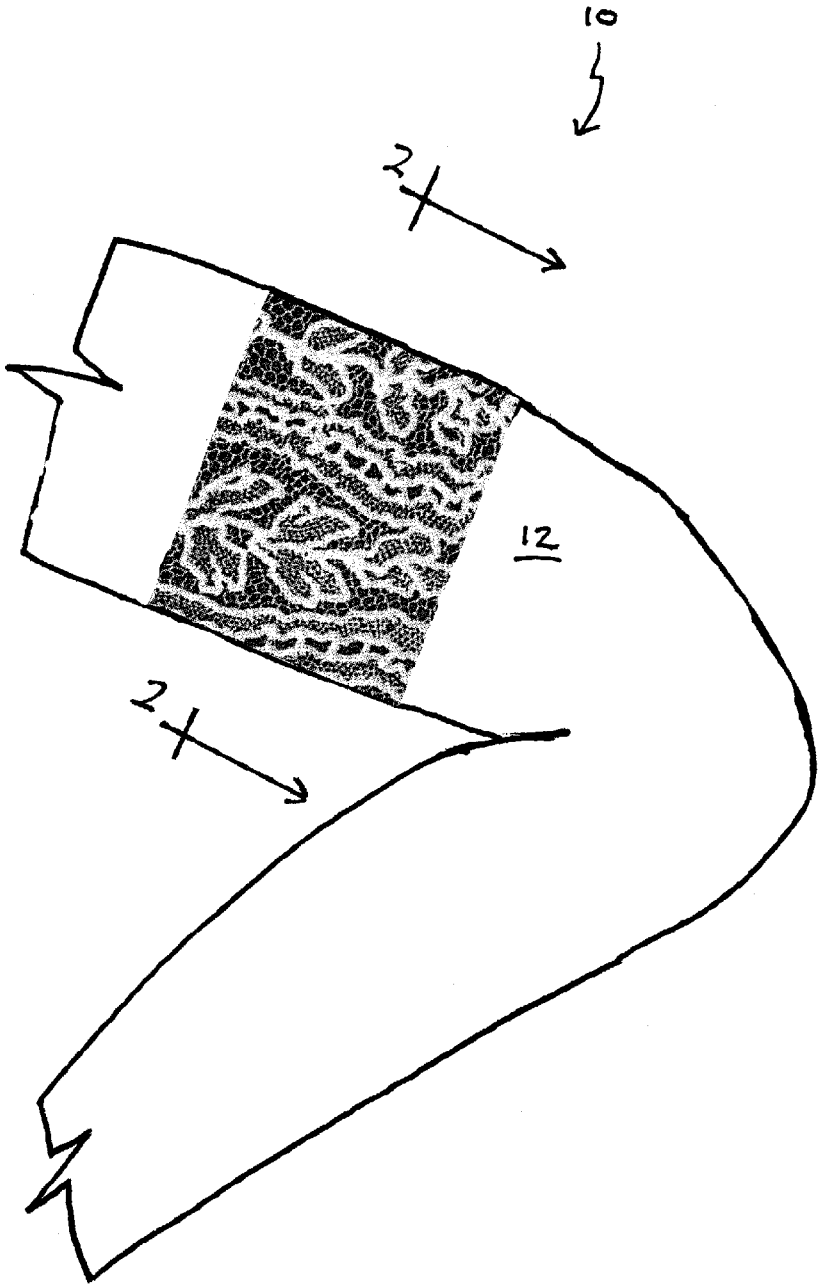
FIG. 1 is a side perspective view of a leg-worn storage device disposed on a leg of a user, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a leg-worn storage device disposed on a leg of a user, according to one embodiment of the invention. There is shown a leg-worn storage device 10 disposed on a leg 12 of a user.

The illustrated leg-worn storage device 10 is configured to store objects about a leg 12 of a user. According to one embodiment of the invention, the leg-worn storage device 10 is configured to include a plurality of inside pockets (see FIG. 4) which are located on the inside face of the device and thus adjacent to and contacting the user's leg when the device is worn. There may be a plurality of layers of fabric coupled together concentrically with a set of pockets between each set of layers. Non-slip treads are disposed on the inside face of the device to help keep the device securely in place. Outside pockets (not illustrated) may also be located on the outside face of the device to provide additional storage. One or more pockets may be selectably removable and coupled to an interior surface of the device by one or more coupling devices (hook-and-loop, snaps, buttons, etc.).

According to one embodiment of the invention, the leg-worn storage device is advantageously configured to provide men or women with the ability to carry daily necessities, essential objects or items and or personal effects (e.g., driver's license, credit cards, cash, cell phone, pass port, keys, make up, reading glasses, etc.) in a secure location on their persons, typically on the upper thigh region of a leg. The device may be expected to eliminate the need to carry a purse or bag for such objects or items while advantageously offering a secure and hidden location for important documents, necessities, effects, microphone packs for speakers, keys, personal hygiene items, medical devices and other essentials that may be found in a purse, wallet or otherwise carried.

According to one embodiment of the invention, there is a leg-worn storage device with pockets. The device may be sized to be approximately 5" to 8" wide and approximately 14" to 36" long depending on the size (e.g., Extra Small, Small, Medium, Large, and Extra Large). When worn, the device may be wrapped around the user's leg, typically at the upper thigh, and fastened using conventional hook and eye closures, snaps, buttons, ties, zippers, tongue and groove devices, adhesives, toggles, clamps, clips, hooks, hook and loop closures (i.e. Velcro brand connectors), and/or the like and combinations thereof. The device may be securely held in place against the wearer's leg through the use of friction enhancing materials/structures, such as but not limited to silicone/rubber/adhesives/tacky materials/dry adhesion materials (such as but not limited to biomimetic adhesives such as but not limited to Geckskin) stamps, treads, patterns, beading, strips, layers, and/or edge piping. The treads/etc. may also be implemented using silicone grippers, silicone backed elastics, or raised silicone beading. The treads/etc. may also be impregnated into an interior layer of the device. Such applying/impregnating may be accomplished by screen-printing, silk screening, spraying, sputtering, stamping, soaking, painting, rolling, injection molding (i.e. two-stage injection molding), gluing, depositing, sewing, pressing, riveting, precipitating, melting, dripping, and/or baking and/or combinations thereof. The treads/etc. are disposed on the inside portions of the device so that they contact the user's leg when the device is worn. The treads/etc. may help to secure the device in place through friction with the user's skin while it is firmly wrapped around the upper thigh to thus allow fluid, uninterrupted movement and private and secure storage of personal effects.

Wherein the friction enhancing layer is imbedded or otherwise impregnated into an interior layer of the device, the device advantageously has enhanced non-slip and/or non-binding properties as well as being more durable. This is especially true wherein the fabric is stretch fabric, such as but not limited to two-way stretch fabric. In particular, wherein the friction enhancing layer is merely laid over the fabric, but does not significantly penetrate thereinto (not being imbedded or impregnated thereinside) as the material stretches and relaxes, the friction enhancing layer will generally begin to detach therefrom. Also, the friction enhancing layer will stretch less and wherein some of the "sticking" properties of the friction enhancing layer is associated with the degree to which the friction enhancing layer is strained orthogonally against the skin, the friction enhancing layer will "stick" better to the leg if it is impregnated into the fabric.

Wherein the fabric is two-way stretch fabric instead of non-stretch, it will interact beneficially with the friction enhancing layer (i.e. silicone tread). Wherein the fabric is two-way stretch fabric instead of four-way stretch fabric, it will have enhanced consistency of placement on the leg, less binding, and a more attractive general appearance. Further, it will not distort the pockets to the same degree which would occur with four-way stretch material.

The treads/etc. may alternatively be made of rubber or any other similar material that is commonly utilized for its skid-resistant, non-slip qualities. In some embodiments of the invention, the treads may be arranged to form various shapes, patterns, letters, pictures, and the like to identify a brand or trade name of the device, or impart other information in a pictorial or written manner, such as but not limited to being presented as a series of script "G" arranged in a repeating array about the interior surface of the device.

The device may generally include between about five to sixteen vertically oriented pockets depending on the size of the device and whether a lace overlay layer is utilized on the outside of the device. The inside pockets, which are held closest to the thigh by the device, may be securely closed by a taught, sewn flap of fabric. The fabric flap allows the user the ability to reach up and into a pocket for easy accessibility, while providing a covered closure of the pocket when the carried objects or items are not needed. The inside pockets may also be closed by hook and loop, snaps, zippers, or other conventional fastening materials and/or devices depending on the requirements of a particular device implementation. Portions of the device may be made from fabric that is breathable, two-way stretch micro-fiber incorporating elastin. Such fabric may be expected to allow the device to expand and wrap around the user's upper thigh for a snug, elastic type fit. A lace overlay may be optionally utilized as an additional layer of 6" two-way stretch lace that provides a second row of pockets on the outside of the device as shown in the view of the outside of device. The outside pockets are not configured with a top closure feature.

Stretch fabric is a term that refers to synthetic fabrics which stretch. Stretch fabrics are split into two categories: 2-way stretch and 4-way stretch. 2-way stretch fabrics stretch in one direction, usually from selvedge to selvedge (but can be in other directions depending on the knit). 4-way stretch fabrics, such as spandex, stretches in both directions, crosswise and lengthwise. Stretch fabrics evolved from the scientific effort to make fibers using neoprene. From this research, stretch fabrics ('elastomerics') such as spandex or elastane (widely branded as 'Lycra') were brought to the market.

The device may be alternatively configured to be very ornate and feminine or utilitarian and more masculine with fabric choices, color choices, closure choices, construction details, and the addition of various ornamentalities such as lace, beading, sequins, crystals, gemstones, feathers, patches, logos, slogans, notions, trimmings, and the like. The elaboration or simplicity selected for a given device may be chosen by the user who may typically include, but is not limited to, brides, brides' maids, mothers of the brides, prom attendants, formal attire wearers, sorority sisters, college students, travelers, concert goers, dress wearers, uniform wearers, moms, hunters, daters, and all other categories of customers that seek a hands-free, purse free, bag-free option for their necessities, documents, effects, and essentials.

According to one embodiment of the invention, other usage scenarios may be the device may also offer television and production crews with a discrete and secure location for microphone/audio transmitter packs that otherwise need to be carried or positioned on more noticeable areas when recording talent. The device may also be used by medical patients who need to carry devices, medications or products with them at all times or temporarily. In other embodiments, the device may be adapted for use in weapon concealment and as a discrete carrier for hidden voice recording and other surveillance devices. Wait staff may use the device to carry work essentials while they wait tables.

According to one embodiment of the invention, the device may also provide a very sexy and alluring way to carry essentials when the user chooses to expose it and not conceal it. Showgirls and exotic dancers may use the device as a sexy way to carry essentials while they work, and flirtatious ladies will enjoy the attention the device gets from gentlemen who see the peek-a-boo of lace from beneath a short skirt. Either concealed or exposed, ornately detailed or discretely plain, the device offers a safe, secure, unexpected option for carrying personal items, work necessities, medical supplies, and other small items that either a man or woman may need.

In one non-limiting embodiment, there is a hands-free purse that is worn on the upper thigh that adheres to the leg of the user with a silicone tread that is impregnated into an interior layer of the hands-free purse. It may be designed to allow people to stash necessities in a concealed location, especially in situations where you cannot use a normal bag. The silicone tread may be a lattice of silicone that warms to the body as it is worn and thus increases in its adhesion properties during wear. Such may allow one to carry substantial weights of materials therein without slippage and without having to rely on a very tight elastic banding that may bind and/or slip.

In one non-limiting embodiment, there is a silicone tread lining/layer that couples to the thigh of the wearer. There may be a silicone layering process for applying/impregnating a layer and/or array of silicone to the container. There may be a cylindrical band having a hook-and-loop (i.e. Velcro) attachment structure for coupling the band to itself into a cylinder. There may be a plurality of concentric rows/arrays of pockets that may be formed by a plurality of fabric layers coupled together along pocket forming regions. There may be one or more flaps and/or other pocket sealing structures. There may be pockets of different sizes, structures and/or orientations. There may be one or more coupling structures and/or devices that may be disposed within/without/about/adjacent to/etc. one or more pockets/layers, including but not limited to ties, straps, snaps, locks, clips, hooks, zippers, and the like and combinations thereof. There may be three layers of two-way stretch/elastic fabric coupled concentrically.

Figure 2:
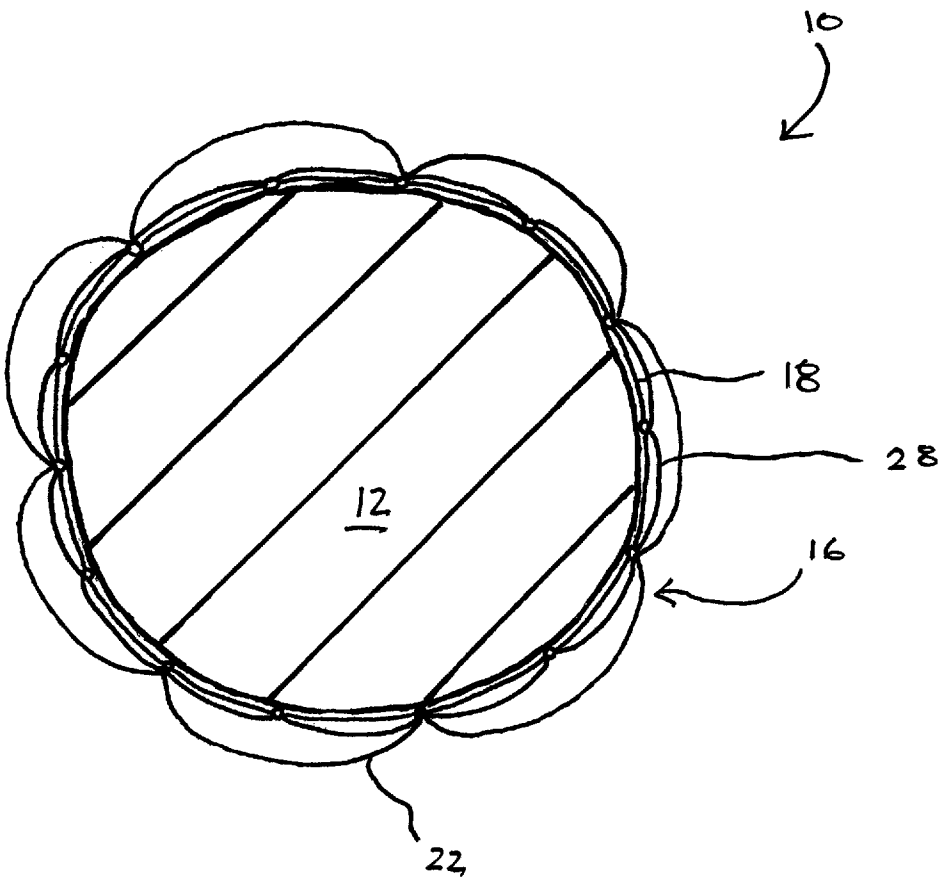
FIG. 2 is a top plan cross-sectional view of a leg-worn storage device wrapped around a leg of a user, according to one embodiment of the invention.

FIG. 2 is a top plan cross-sectional view of a leg-worn storage device wrapped around a leg of a user, according to one embodiment of the invention. There is shown a leg-worn storage device 10 wrapped around a leg 12 of a user.

The illustrated leg-worn storage device 10 is configured to store objects about a leg 12 of a user. The device 10 includes a cylindrical band 16 of two-way elastic fabric, including three layers of such fabric 22, 28 and 18 coupled together concentrically. The two-way elastic fabric is configured to stretch in each direction, horizontally, left and right. The cylindrical band 16 includes an interior layer 18 of two-way elastic fabric that includes a friction enhancing texture layer protruding therefrom and penetrating thereinside. The cylindrical band 16 also includes an exterior layer 22 of two-way elastic fabric that is coupled to the interior layer 18.

Figure 3:
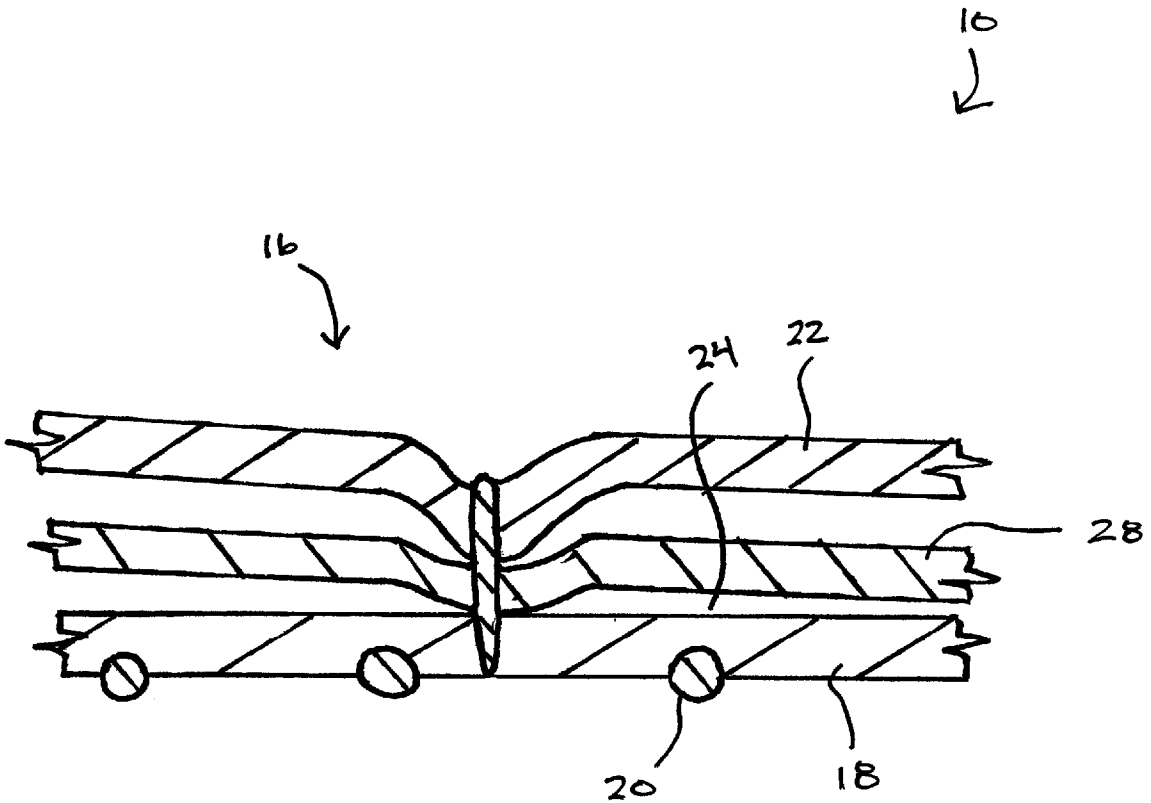
FIG. 3 is a partial cross-sectional top plan view of a leg-worn storage device showing coupled layers of fabric and embedded tread, according to one embodiment of the invention.

FIG. 3 is a partial cross-sectional top plan view of a leg-worn storage device showing coupled layers of fabric and embedded tread, according to one embodiment of the invention. There is shown a leg-worn storage device 10 including a cylindrical band 16 having an interior layer 18, a middle layer 28, and an exterior layer 22.

The illustrated leg-worn storage device 10 is configured to store objects about a leg of a user. The device 10 includes a cylindrical band 16 of two-way elastic fabric. The cylindrical band 16 includes an interior layer 18 of two-way elastic fabric having a friction enhancing texture layer 20 protruding therefrom and penetrating thereinside. The illustrated friction enhancing texture layer 20 is silicone that is imbedded/impregnated into the interior layer of fabric such that the silicone envelopes fibers of the interior fabric layer and thereby travels therewith when that layer of fabric is stretched. The friction enhancing texture layer 20 is configured to support the leg-worn storage device 10 about a thigh region of a user. The friction enhancing texture layer 20 is configured to support the leg-worn storage device 10, while not cutting off circulation to the rest of the leg from the tightness of the elastic fabric.

The cylindrical band 16 includes an exterior layer 22 of two-way elastic fabric that is coupled to the interior layer 18. The illustrated cylindrical band 16 includes a middle layer 28 of two-way elastic fabric that is coupled between the interior layer 18 and an exterior layer 22. The illustrated cylindrical band 16 includes a pocket (See FIG. 4, 24) formed between the interior layer 18 and the middle layer 28. The pocket 24 boundaries are formed by the stitching of the interior layer 18 to the exterior layer 22. A similar pocket is formed between the middle layer 28 and the exterior layer 22.

Figure 4:
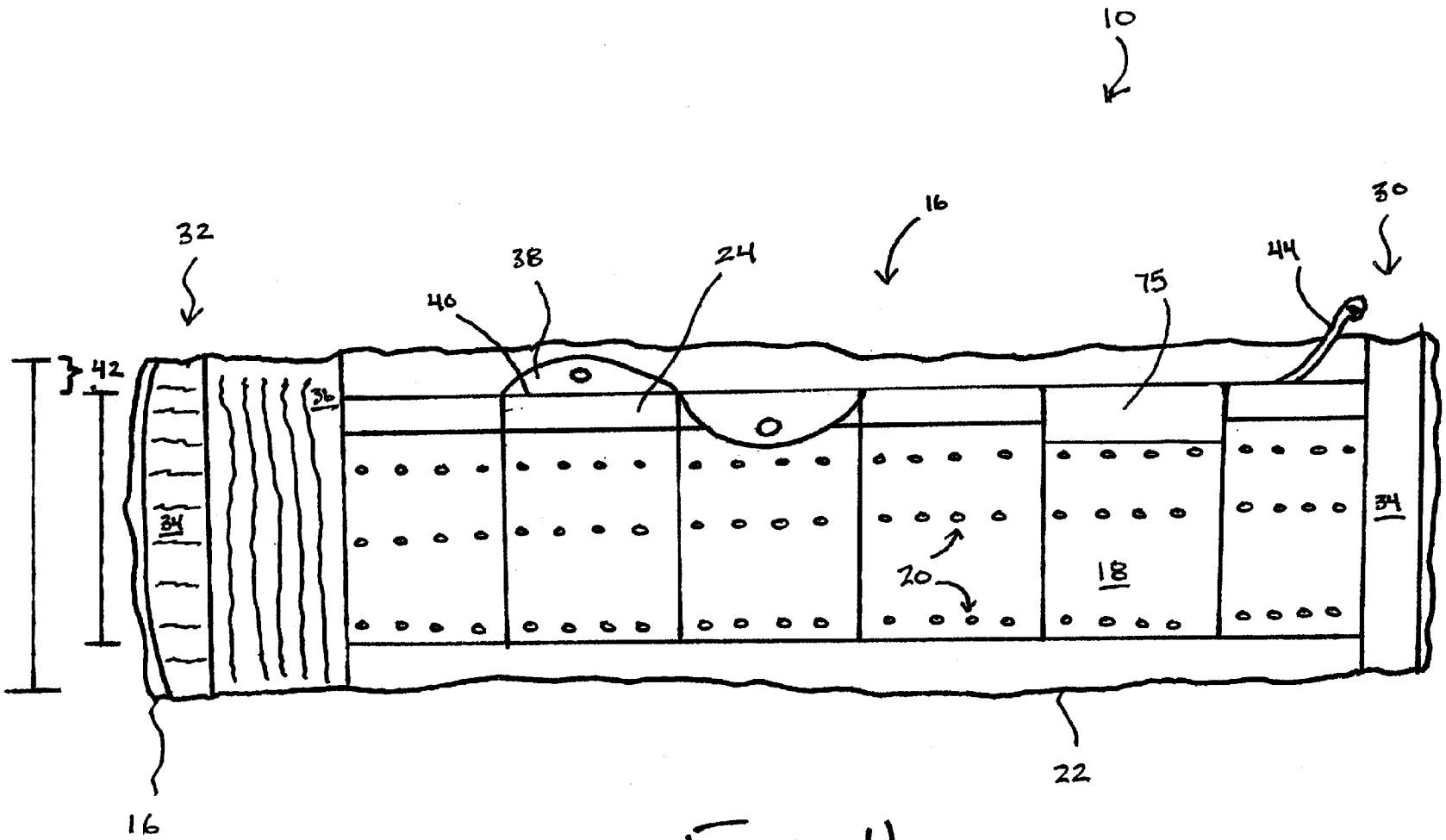
FIG. 4 is a side elevational view of an interior region of an unfurled leg-worn storage device, according to one embodiment of the invention.

FIG. 4 is a side elevational view of an interior region of an unfurled leg-worn storage device, according to one embodiment of the invention. There is shown a leg-worn storage device 10 including a cylindrical band 16 including an interior layer 18, an exterior layer 22, and a plurality of pockets 24.

The illustrated leg-worn storage device 10 is configured to store objects about a leg of a user. The device 10 includes a cylindrical band 16 of two-way elastic fabric. The cylindrical band 16 includes an interior layer 18 of two-way elastic fabric having a friction enhancing texture layer 20 protruding therefrom and penetrating thereinside. The cylindrical band 16 includes an exterior layer 22 of two-way elastic fabric that is coupled to the interior layer 18. The illustrated cylindrical band 16 includes a plurality of pockets 24 formed between the interior layer 18 and the exterior layer 22. The pockets are selectably accessible from an exterior of the cylindrical band 16 thus permitting the storage of objects. The exterior layer 22 is taller than 42 the interior layer 18, thereby substantially concealing the interior layer 18 when in use.

The illustrated cylindrical band 16 includes a first end region 30 that is selectably coupled to a second end region 32. The cylindrical band 16 includes a mating coupling device 34 disposed at each of the first end region 30 and the second end region 32. The mating coupling device 34 is configured to selectably couple the first end region 30 to the second end region 32. Wherein the mating coupling device is hook-and-loop structure, the illustrated mating coupling device 34 of the first end region 30 is on the exterior side (not shown in FIG. 4), such as the mating coupling device 34 is disposed on the opposite side to selectably couple to the mating coupling device 34 of the second end region 32.

The illustrated cylindrical band 16 includes a secondary coupling device 36 disposed near the second end region 32. The secondary coupling device 36 is configured to selectably couple the second end region 32 thereto. The secondary coupling device is configured to couple to the mating coupling device 34 of the second end region 32, when not coupled to the mating coupling device 34 of the first end region 30, such as when not is use. There may be a mating structure 36 adjacent to the mating structure 34 near side 32 that may couple to such mating structure in order to keep that mating structure 34 from coupling to clothing, tablecloths, and other materials when it is not coupled to its corresponding mating structure 34 on the other side 30. This is particularly helpful wherein the mating structure 34 of side 32 is the hook structure of a hook-and-loop device, as such structure will readily connect in unwanted ways to lace, hose, socks, underclothes, and etc. In such a case, the mating structure 36 would be loop-style structure configured to receive and neutralize the hook structure 34.

The illustrated cylindrical band 16 includes a pocket flap 38 disposed about an aperture 40 of the pocket 24. The pocket flap 38 is configured to secure objects within the pocket 24. The illustrated cylindrical band 16 includes an elongated coupling device 44 extending from the pocket 24. The elongated coupling device 44 is configured to selectably couple to a personal object. The illustrated cylindrical band 16 includes a pocket over flap 75 extending over an aperture of the pocket 24 and configured to secure objects and contents within the pocket 24. The pocket over flap 75 is configured to be part of the interior layer 18; wherein the interior layer includes extended fabric configured to be sewn onto itself on the edges of the pocket, thereby creating the pocket over flap 75.

Figure 5:
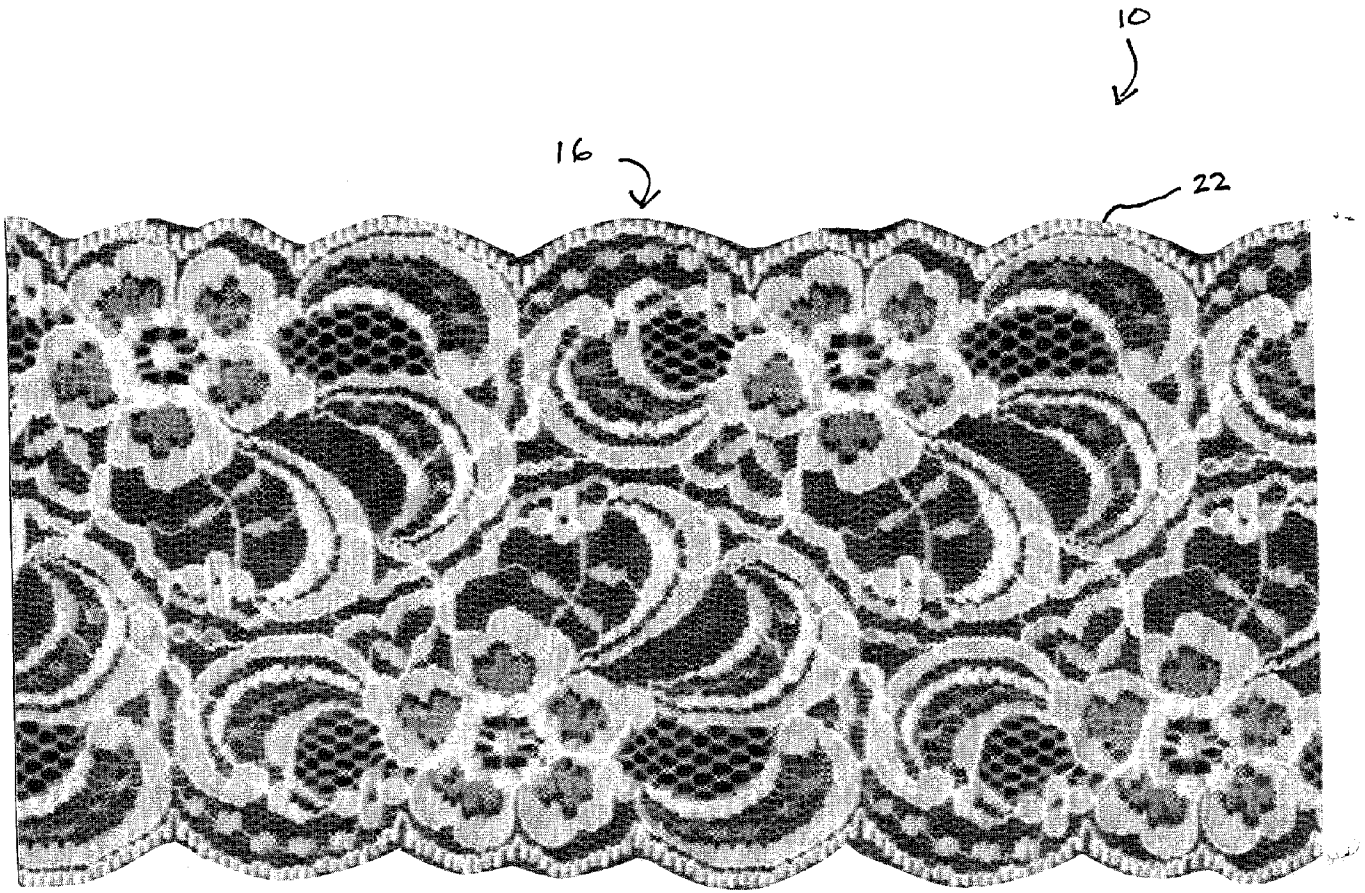
FIG. 5 is a side plan elevational view of an exterior region of an unfurled leg-worn storage device, according to one embodiment of the invention.

FIG. 5 is a side plan elevational view of an exterior region of an unfurled leg-worn storage device, according to one embodiment of the invention. There is shown an exterior layer 22 of a leg-worn storage device 10.

The illustrated leg-worn storage device 10 is configured to store objects about a leg of a user. The device 10 includes a cylindrical band 16 of two-way elastic fabric. The cylindrical band 16 includes an exterior layer 22 of two-way elastic fabric. The illustrated exterior layer 22 consists essentially of two-way elastic lace. There may be a plurality of decorative layers, such as but not limited to two-way elastic lace and other decorative/aesthetic fabrics, such as but not limited to velvet, corduroy, faux suede, silk, textured fabrics, damask, metallic fabrics, tweed, wool, cotton, yarn and the like and combinations thereof.

Figure 6:
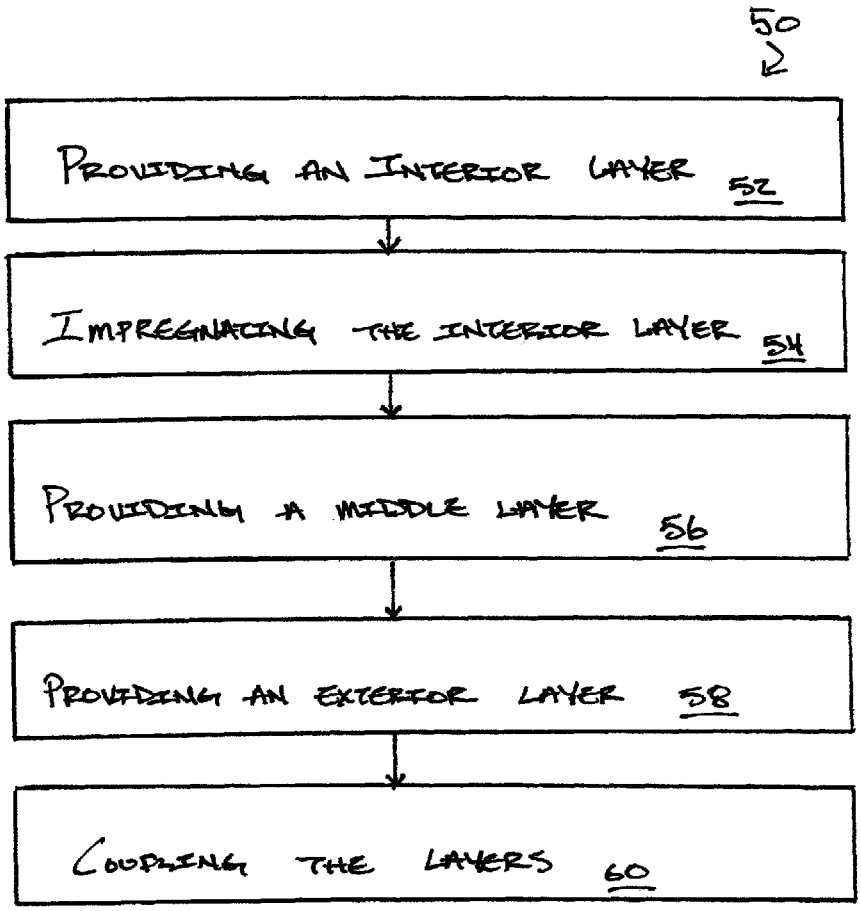
FIG. 6 is a flow chart of a method of manufacturing a leg-worn storage device, according to one embodiment of the invention.

FIG. 6 is a flow chart of a method of manufacturing a leg-worn storage device, according to one embodiment of the invention. There is shown a method of manufacturing a leg-worn storage device 50.

The illustrated method of manufacturing a leg-worn storage device 50 includes the step of providing an interior layer of two-way elastic fabric 52.

The method 50 includes the step of impregnating the interior layer of two-way elastic fabric with a friction enhancing texture layer, such that the friction enhancing texture layer is imbedded within the interior layer and extends outwardly therefrom 54. Imbedding may be performed by one or more methods that cause the friction enhancing texture layer to envelope one or more fibers of the interior layer, such as but not limited to silk screening, screen printing, melting, soaking, spraying, and the like and combinations thereof. The friction enhancing layer may be a dry adhesive type material such as but not limited to silicone, rubber, biomimetic dry adhesives and the like and combinations thereof.

The method 50 includes the step of providing a middle layer of two-way elastic fabric 56 and also the step of providing an exterior layer of two-way elastic fabric 58. The method of manufacturing a leg-worn storage device 50 includes the step of coupling the interior layer of two-way elastic fabric to the middle layer of two-way elastic fabric and to the exterior layer two-way fabric to form a cylindrical band of two-way elastic fabric having a plurality of interior pockets configured to store object therein and a friction-enhanced interior surface configured to adhere to a leg of a user when worn about a leg of a user 60. Such coupling may be performed by stitching, stapling, gluing, stamping, heat-pressing and the like and combinations thereof.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate a particular lace style, it is understood that the decorative effects of the present invention are plethoric and varied, including but not limited to being plain or adding jewelry-styled effects such as but not limited to gemstone settings, metallic ribbons, chains, studs, and the like and combinations thereof.

Additionally, although the figures illustrate a generally rectangular unfurled device, the device may be shaped otherwise, such as but not limited to oval, circular, squared, irregular, triangular and the like and combinations thereof.

It is also envisioned that pocket configurations, locations, positions, orientations, sizes and the like may be varied and plethoric.

Finally, it is envisioned that the components of the device may be constructed of a variety of materials, including but not limited to metals, ceramics, fabrics, natural fibers, synthetic fibers, composites, stones, gemstones, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A leg-worn storage device configured to store objects about a leg of a user, comprising:

a. a cylindrical band of two-way elastic fabric, including:

i. an interior layer of two-way elastic fabric having a friction enhancing texture layer protruding therefrom and penetrating thereinside;

ii. an exterior layer of two-way elastic fabric coupled to the interior layer;

iii. a pocket formed between the interior layer and the exterior layer;

wherein the pocket is selectably accessible from an exterior of the cylindrical band this permitting the storage of objects; and iv. a middle layer of two-way elastic fabric coupled between the interior layer and the exterior layer.

2. The device of claim 1, wherein the friction enhancing texture layer is silicone.

3. The device of claim 1, wherein the cylindrical band further includes a first end region selectably coupled to a second end region.

4. The device of claim 3, further comprising a mating coupling device disposed at each of the first end region and the second end region and configured to selectably couple the first end region to the second end region.

5. The device of claim 4, further comprising a secondary coupling device disposed near the second end region and configured to selectably couple the second end region thereto.

6. The device of claim 1, further comprising a pocket flap disposed about an aperture of the pocket and configured to secure objects within the pocket.

7. The device of claim 1, wherein the exterior layer is taller than the interior layer, thereby substantially concealing the interior layer when in use.

8. The device of claim 1, further comprising an elongated coupling device extending from the pocket and configured to selectably couple to a personal object.

9. The device of claim 1, wherein the exterior layer consists essentially of two-way elastic lace.

10. The device of claim 1, wherein the pocket is formed by stitching of the interior layer to the exterior layer.

11. A leg-worn storage device configured to store objects about a leg of a user, comprising:

a. a cylindrical band of elastic fabric, including:

i. an interior layer of elastic fabric having a friction enhancing texture layer protruding therefrom and penetrating thereinside;

ii. an exterior layer of elastic fabric coupled to the interior layer;

iii. a pocket formed between the interior layer and the exterior layer;

wherein the pocket is selectably accessible from an exterior of the cylindrical band this permitting the storage of objects; and iv. a middle layer of two-way elastic fabric coupled between the interior layer and the exterior layer.

12. The device of claim 11, wherein the friction enhancing texture layer is silicone.

13. The device of claim 12, wherein the cylindrical band further includes a first end region selectably coupled to a second end region.

14. The device of claim 13, further comprising:

a) a mating coupling device disposed at each of the first end region and the second end region and configured to selectably couple the first end region to the second end region; and b) a secondary coupling device disposed near the second end region and configured to selectably couple the second end region thereto.

15. The device of claim 14, further comprising a pocket flap disposed about an aperture of the pocket and configured to secure objects within the pocket.

16. The device of claim 15, wherein the exterior layer is taller than the interior layer, thereby substantially concealing the interior layer when in use.

17. The device of claim 16, further comprising an elongated coupling device extending from the pocket and configured to selectably couple to a personal object.

18. A method of manufacturing a leg-worn storage device, comprising the steps of:

a) providing an interior layer of two-way elastic fabric;

b) impregnating the interior layer of two-way elastic fabric with a friction enhancing texture layer such that the friction enhancing texture layer is imbedded within the interior layer and extends outwardly therefrom;

c) providing a middle layer of two-way elastic fabric;

d) providing an exterior layer of two-way elastic fabric; and e) coupling the interior layer of two-way elastic fabric to the middle layer of two-way elastic fabric and to the exterior layer two-way fabric to form a cylindrical band of two-way elastic fabric having a plurality of interior pockets configured to store object therein and a friction-enhanced interior surface configured to adhere to a leg of a user when worn about a leg of a user.

* * * * *